US007253776B2

(12) United States Patent
Miyagi

(10) Patent No.: US 7,253,776 B2
(45) Date of Patent: Aug. 7, 2007

(54) FM RADIO RECEIVER

(75) Inventor: Hiroshi Miyagi, Tokyo (JP)

(73) Assignee: Neuro Solution Corp., Tokyo (JP)

( * ) Notice: Subject to any disclaimer, the term of this patent is extended or adjusted under 35 U.S.C. 154(b) by 103 days.

(21) Appl. No.: 11/326,027

(22) Filed: Jan. 4, 2006

(65) Prior Publication Data

US 2006/0152423 A1 Jul. 13, 2006

(30) Foreign Application Priority Data

Jan. 7, 2005 (JP) ..... 2005-002064

(51) Int. Cl.
*H01Q 1/32* (2006.01)

(52) U.S. Cl. ..... 343/711; 343/713; 343/895; 455/131; 455/345

(58) Field of Classification Search ..... 343/711, 343/713, 715, 821, 895; 455/131, 345
See application file for complete search history.

(56) References Cited

U.S. PATENT DOCUMENTS 4,977,615 A * 12/1990 Suzuki et al. ..... 455/277.2
5,121,504 A * 6/1992 Toko ..... 455/575.9
5,155,494 A * 10/1992 Bryant et al. ..... 343/713
2005/0107045 A1* 5/2005 Kroeger ..... 455/83
2006/0164210 A1* 7/2006 Ikeo ..... 340/5.72

* cited by examiner

*Primary Examiner*—Tan Ho
(74) *Attorney, Agent, or Firm*—patenttm.us; James H. Walters

(57) ABSTRACT

An object of the invention is to provide an FM radio receiver capable of improving the receiving state. The radio receiver 10 is disposed within a vehicle room and provided with a vehicle-mounted antenna connection terminal 12. The radio receiver 10 includes a front-end unit converting to an intermediate frequency signal an FM broadcast signal received via a vehicle-mounted antenna 110, a signal line inserted between the vehicle-mounted antenna connection terminal 12 and the front-end unit, and an in-vehicle antenna 14 branching out from the signal line. A radio wave transmitted from an FM transmitter 40 disposed within the vehicle room via an antenna 42 is received by the radio receiver 10 via the in-vehicle antenna 14.

17 Claims, 6 Drawing Sheets

FM RADIO RECEIVER

BACKGROUND OF THE INVENTION

1. Field of the Invention

The present invention relates to an FM radio receiver mounted on a vehicle.

2. Description of the Related Art

There has hitherto been known an vehicle-mounted system in which an FM transmitter is connected to an audio reproducing player or the like and a radio wave transmitted from the FM transmitter is received by a car radio (for example, refer to Japanese Patent Laid-Open No. 6-309854). In this vehicle-mounted system, a vehicle-mounted antenna is used for the car radio to receive the radio wave.

In the above described vehicle-mounted system, however, a radio wave transmitted from the FM transmitter installed within the vehicle room is received by use of the vehicle-mounted antenna provided outside the vehicle body, so the receiving state deteriorates, thus causing a problem. In Japanese Patent Laid-Open No. 6-309854, there is a description such that since the FM transmitter and the vehicle-mounted antenna are very close to each other, reception can be performed by use of the vehicle-mounted antenna without trouble. However, the vehicle body is largely made of metal. In addition, a patterned conductor of heater for defrosting is often attached to the rear window. Thus a radio wave transmitted from the FM transmitter installed within the vehicle room hardly reaches the vehicle-mounted antenna disposed in the vicinity of the trunk or the like. Consequently, when the transmission level of a radio wave transmitted from the FM transmitter is low, satisfactory reception is difficult to achieve via the vehicle-mounted antenna.

SUMMARY OF THE INVENTION

The present invention has been achieved in view of the above described circumstances, and has an object to provide a FM radio receiver capable of improving the receiving state.

To solve the above problem, an FM radio receiver according to the present invention is installed within a vehicle room and provided with a vehicle-mounted antenna connection terminal, and comprises a front-end unit converting to an intermediate frequency signal an FM broadcast signal received via a vehicle-mounted antenna, a signal line inserted between the vehicle-mounted antenna connection terminal and the front-end unit, and an in-vehicle antenna branching out from the signal line. The in-vehicle antenna branches out from the signal line positioned between the front-end unit of the FM radio receiver mounted on the vehicle and the vehicle-mounted antenna connection terminal, and a transmitting radio wave from an FM transmitter used within the vehicle room can be received via this in-vehicle antenna. Accordingly, the receiving state can be improved compared to when reception is performed via the vehicle-mounted antenna.

Preferably, the above described in-vehicle antenna is directly connected to the signal line, whereby a radio wave transmitted toward the interior of the vehicle room can be received more satisfactorily with a simple configuration.

Preferably, a balun is further provided which is inserted in the path of the above described signal line, and the signal line and the in-vehicle antenna are connected to each other via the balun, whereby impedance matching can easily be achieved when both the vehicle-mounted antenna and the in-vehicle antenna are connected to the FM radio receiver, and the front-end unit can efficiently receive signals corresponding to radio waves received via the vehicle-mounted antenna and the in-vehicle antenna, respectively.

Preferably, the above described in-vehicle antenna is a wire composed of a flexible metal conductor covered with an insulating material and is exposed to the outside from a housing having housed therein the signal line, whereby the in-vehicle antenna withdrawn from the FM radio receiver can easily be housed in an empty space within the dashboard.

Preferably, the above described in-vehicle antenna is a wire composed of an inflexible metal conductor covered with an insulating member and is disposed outside the housing having housed therein the signal line and positioned substantially parallel to one face of the housing, whereby the protrusion of the in-vehicle antenna toward the outside of the FM radio receiver can be reduced.

Preferably, the above described in-vehicle antenna is a conductor attached to the surface or rear surface of the housing having housed therein the front-end unit, whereby the in-vehicle antenna can be prevented from protruding from the FM radio receiver toward the outside.

Preferably, the above described in-vehicle antenna is formed in a spiral manner across the surface or rear surface of the housing, whereby the length of the in-vehicle antenna can be secured and at the same time the in-vehicle antenna can be prevented from protruding toward the outside of the housing.

Preferably, the above described in-vehicle antenna is a bar antenna composed of a coil wound around a magnetic core and is disposed within the housing having housed therein the front-end unit, whereby the size of the in-vehicle antenna can be reduced to be surely housed in the housing.

Preferably, a wiring having a small fluctuation in voltage is utilized as the in-vehicle antenna, whereby the in-vehicle antenna needs not to be provided as a separate component, thus the configuration can be simplified. Particularly the in-vehicle antenna having a certain length needs not to be added, so there is an advantage in that no limitation on the arrangement of components is imposed and designing is facilitated.

Preferably, the above described wiring is a signal line for driving light emitting diodes illuminating the screen of a display device. Alternatively, the above described wiring is preferably a signal line for driving a light emitting diode indicating the active state. The power source voltage is usually applied stably to these light emitting diodes after when the FM radio receiver is turned on and until when it is turned off, so the signal line for driving light emitting diodes can be used as the in-vehicle antenna. In addition, since no specific signal is inputted/outputted to/from the signal line for driving light emitting diodes, the degree of freedom in setting the wiring path is large, and the length and shape required of the in-vehicle antenna are easy to secure.

Preferably, the above described signal line for driving is connected to the signal line via a capacitor, whereby the operating voltage applied to the signal line for driving can be separated and a receiving signal running through the signal line for driving can be extracted.

Preferably, the above described signal line for driving is connected to the power source via a choke coil, whereby noises running through the power line can be prevented from being inputted to the front-end unit via the signal line for driving acting as the in-vehicle antenna.

DETAILED DESCRIPTION OF THE PREFERRED EMBODIMENTS

Figure 1:
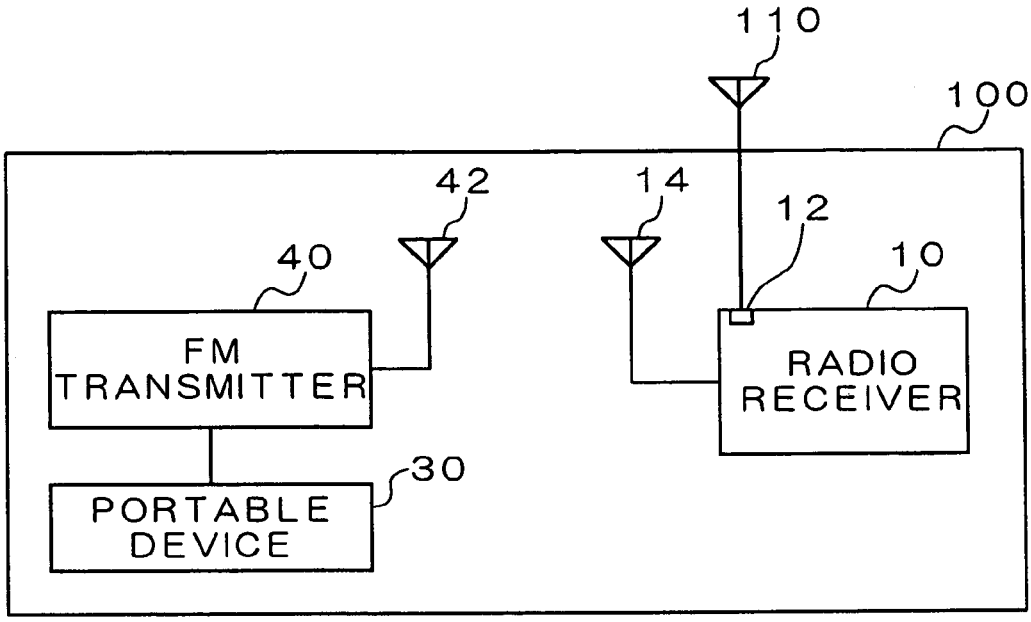
FIG. 1 is a view showing the overall configuration of a vehicle-mounted system including a radio receiver according to one embodiment.

A radio receiver according to one embodiment of the present invention will be described below in detail with reference to the drawings. FIG. 1 is a view showing the overall configuration of a vehicle-mounted system including a radio receiver according to one embodiment. The vehicle-mounted system shown in FIG. 1 comprises a radio receiver 10 mounted on a vehicle 100, a portable device 30, and an FM transmitter 40. The radio receiver 10 is installed in the dashboard of the vehicle 100, and receives FM radio broadcasts and AM radio broadcasts to output sound signals corresponding to the respective broadcast contents. These sound signals are outputted from a loudspeaker (not shown) mounted on the vehicle 100 toward the interior of the vehicle room. The radio receiver 10 includes a vehicle-mounted antenna connection terminal 12. A vehicle-mounted antenna 110 exposed to the outside of the vehicle 100 body is connected to this connection terminal 12.

Figure 2:
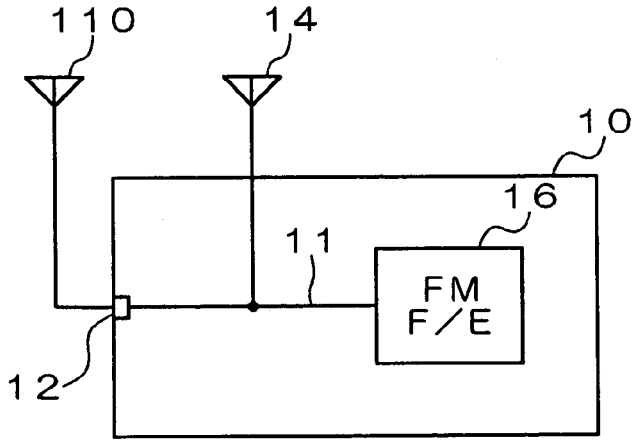
FIG. 2 is a view showing a fragmentary configuration of the radio receiver.

FIG. 2 is a view showing a fragmentary configuration of the radio receiver 10. As shown in FIG. 2, the radio receiver 10 comprises a front-end unit (FM F/E) 16 converting a received FM broadcast signal to an intermediate frequency signal, a signal line 11 inserted between the vehicle-mounted antenna connection terminal 12 and the front-end unit 16, and an in-vehicle antenna 14 branching out from the signal line 11. In the present embodiment, the branching point of the in-vehicle antenna 14 is disposed at the intermediate position of the signal line 11 composed of a co-axial cable or the like.

The portable device 30 shown in FIG. 1 is an audio device, a mobile telephone or the like carried by a passenger such as a driver. A sound signal outputted therefrom is supplied to the FM transmitter 40. The FM transmitter 40 applies FM modification to the sound signal supplied from the portable device 30 and outputs the resultant signal via an antenna 42.

As described above, by disposing the in-vehicle antenna 14 so as to branch out from the signal line 11 between the front-end unit 16 of the radio receiver 10 mounted on the vehicle 100 and the vehicle-mounted antenna connection terminal 12, a transmitting radio wave from the FM transmitter 40 used within the vehicle room can be received by the radio receiver 10 via this in-vehicle antenna 14. Accordingly, the receiving state can be improved compared to when reception is performed via the vehicle-mounted antenna 110. Particularly, by connecting the in-vehicle antenna 14 directly to the signal line 11 disposed within the radio receiver 10, a radio wave transmitted toward the interior of the vehicle room can be received more satisfactorily with a simple configuration.

Figure 3:
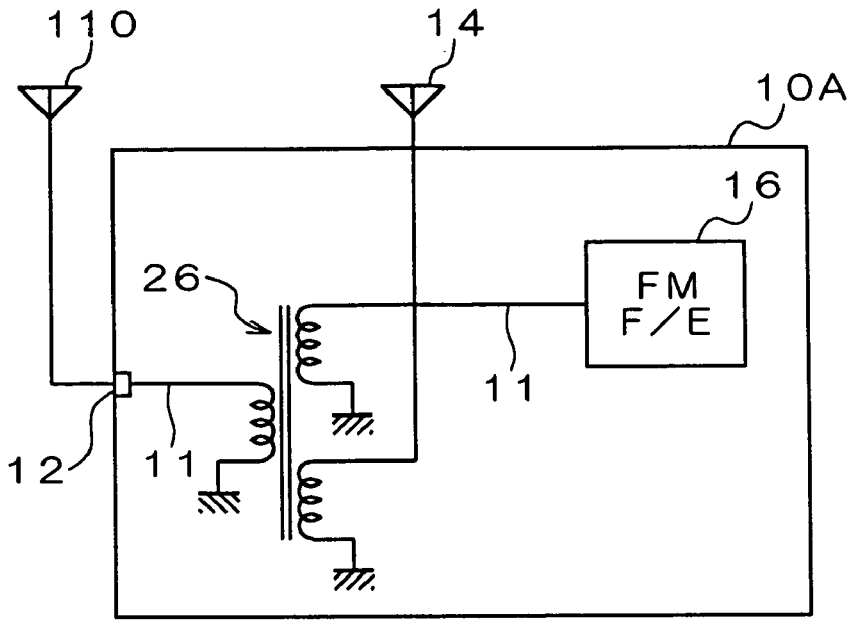
FIG. 3 is a view showing a variation of the radio receiver.

FIG. 3 is a view showing a variation of the radio receiver. The radio receiver 10A shown in FIG. 3 comprises a balun 26. The balun 26 is an impedance converting transformer, in which a coil in the primary side is connected to the vehicle-mounted antenna 110 via a connection terminal 12, and one coil in the secondary side is connected to a front-end unit 16, and the other coil is connected to the in-vehicle antenna 14.

Figure 4:
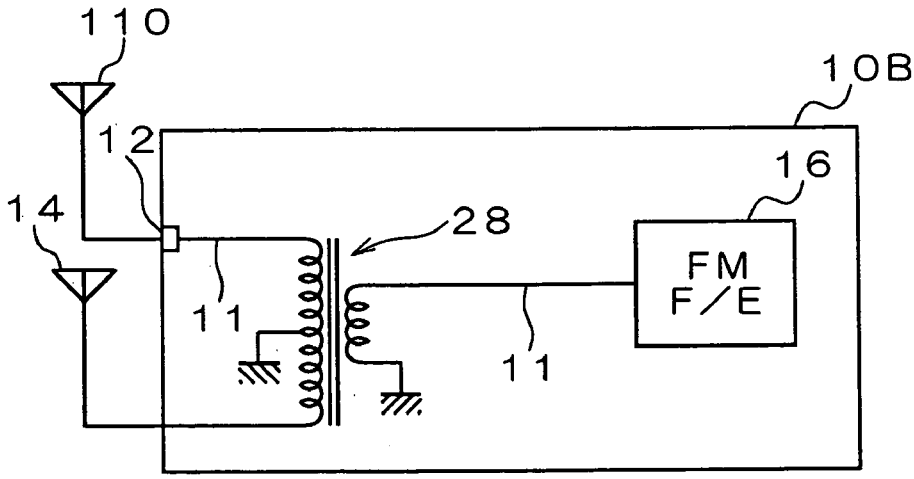
FIG. 4 is a view showing another variation of the radio receiver.

FIG. 4 is a view showing another variation of the radio receiver. The radio receiver 10B shown in FIG. 4 comprises a balun 28. The balun 28 has a different configuration than the balun 26 shown in FIG. 3. In the balun 28, a tap provided in a coil in the primary side is connected to the ground, and one end of this coil is connected to the vehicle-mounted antenna 110, and the other end is connected to the in-vehicle antenna 14. A coil in the secondary side is connected to a front-end unit 16.

By using the balun 26 shown in FIG. 3 or the balun 28 shown in FIG. 4 in this way, impedance matching can easily be achieved when both the vehicle-mounted antenna 110 and the in-vehicle antenna 14 are connected to the radio receiver 10. Thus it is possible to reduce the loss of signals corresponding to radio waves received by the vehicle-mounted antenna 110 and the in-vehicle antenna 14, respectively, and efficiently supply the signals to the front-end unit 16 of the radio receiver 10.

Figure 5:
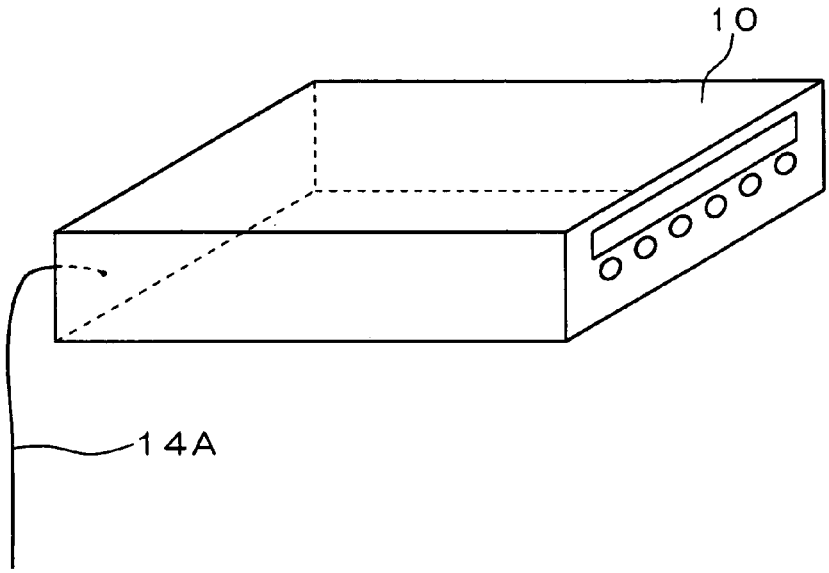
FIG. 5 is a view showing a concrete example of in-vehicle antenna connected to the radio receiver.

FIG. 5 is a view showing a concrete example of in-vehicle antenna connected to the radio receiver 10. The in-vehicle antenna 14A shown in FIG. 5 is a wire composed of a flexible metal conductor covered with an insulating member and is exposed to the outside from the housing of the radio receiver 10, whereby the in-vehicle antenna 14A withdrawn from the radio receiver 10 can easily be housed in an empty space within the dashboard.

Figure 6:
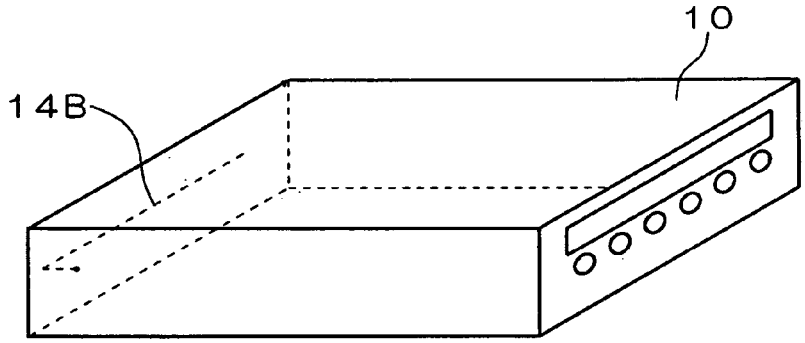
FIG. 6 is a view showing another concrete example of in-vehicle antenna connected to the radio receiver.
Figure 7:
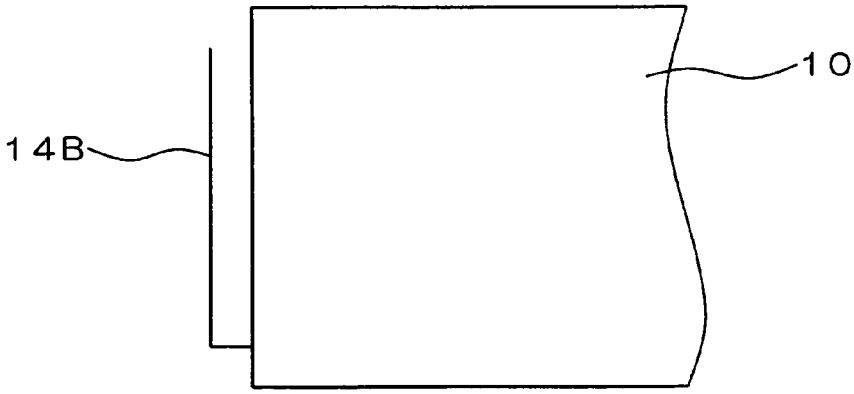
FIG. 7 is a fragmentary plan view of a housing having attached thereto the in-vehicle antenna.

FIG. 6 is a view showing another concrete example of in-vehicle antenna connected to the radio receiver 10. FIG. 7 is a fragmentary plan view of a housing having attached thereto the in-vehicle antenna. The in-vehicle antenna 14B shown in FIGS. 6 and 7 is a wire composed of an inflexible metal conductor covered with an insulating member and is disposed outside the housing of the radio receiver 10 and positioned substantially parallel to one face (the rear surface, for example) of the housing, whereby the protrusion of the in-vehicle antenna 14B toward the outside of the radio receiver 10 can be reduced.

Figure 8:
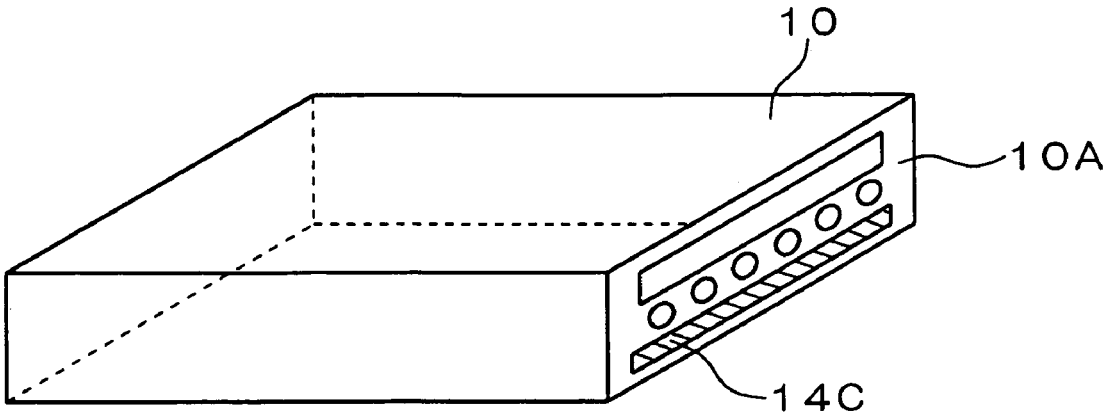
FIG. 8 is a view showing another concrete example of in-vehicle antenna connected to the radio receiver.

FIG. 8 is a view showing another concrete example of in-vehicle antenna connected to the radio receiver 10. The in-vehicle antenna 14C shown in FIG. 8 is attached to the front face 10A of the housing of the radio receiver 10, whereby the in-vehicle antenna 14C can be prevented from protruding from the radio receiver 10 toward the outside. The in-vehicle antenna 14C may be attached to another face or the rear surface (the inner surface) of the housing.

Figure 9:
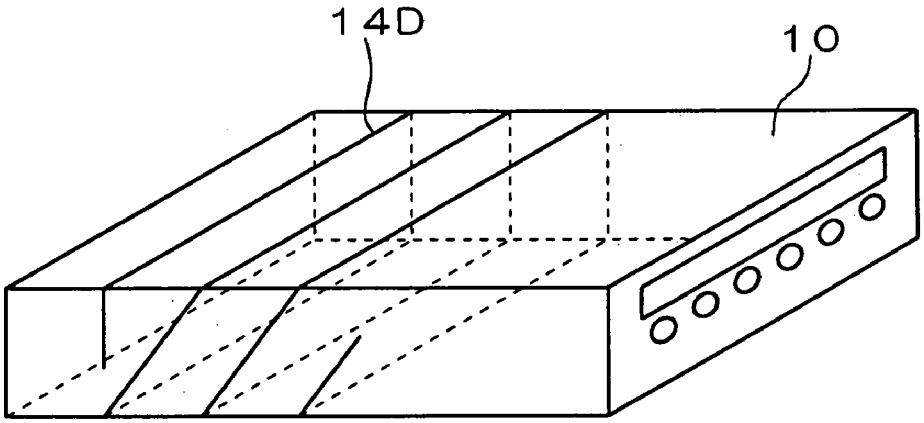
FIG. 9 is a view showing another concrete example of in-vehicle antenna connected to the radio receiver.

FIG. 9 is a view showing another concrete example of in-vehicle antenna connected to the radio receiver 10. The in-vehicle antenna 14D shown in FIG. 9 is formed in a spiral manner across the surface of the housing of the radio receiver 10, whereby the length of the in-vehicle antenna 14D can be secured and at the same time the in-vehicle antenna 14D can be prevented from protruding toward the outside of the housing. The in-vehicle antenna 14D may be attached to the rear surface (the inner surface) of the housing.

Figure 10:
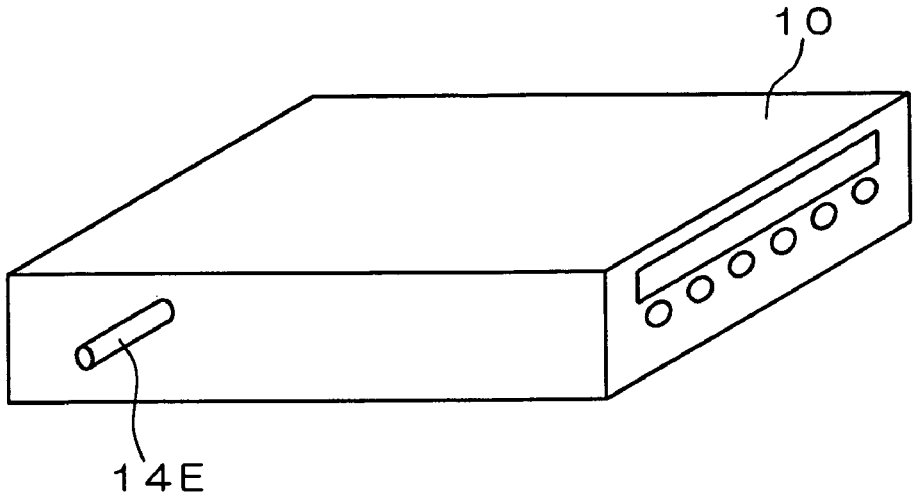
FIG. 10 is a view showing another concrete example of in-vehicle antenna connected to the radio receiver.

FIG. 10 is a view showing another concrete example of in-vehicle antenna connected to the radio receiver 10. The in-vehicle antenna 14E shown in FIG. 10 is a bar antenna composed of a coil wound around a magnetic core, such as a ferrite core, and is disposed within the housing of the radio receiver 10, whereby the size of the in-vehicle antenna 14E can be reduced to be surely housed within the housing.

Figure 11:
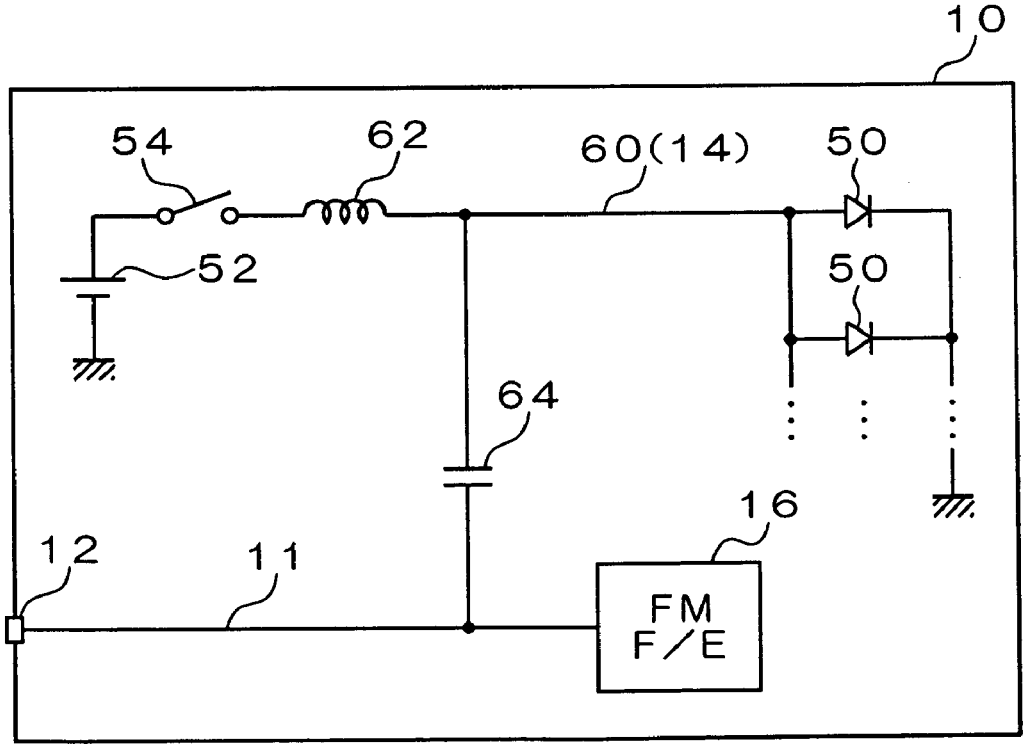
FIG. 11 is a view showing another concrete example of in-vehicle antenna connected to the radio receiver.

FIG. 11 is a view showing another concrete example of in-vehicle antenna connected to the radio receiver 10. The radio receiver 10 shown in FIG. 11 comprises a plurality of light emitting diodes 50 acting as the backlight of a liquid crystal display device (LCD), a power source 52, a switch 54 and a choke coil 62 inserted in a driving signal line 60 which connects the power supply 52 and each light emitting diode 50, and a capacitor 64 inserted between a signal line 11 and the driving signal line 60.

When the switch 54 is turned on, a terminal voltage of the power source 52 is applied to each light emitting diode 50 to turn it on. When the radio receiver 10 is in operation, the lighting state of each light emitting diode 50 is maintained, so the voltage of the driving signal line 60 remains stable without fluctuating. Accordingly, the driving signal line 60 can be used as the in-vehicle antenna 14. In addition, the in-vehicle antenna needs not to be provided as a separate component, thus the configuration of the radio receiver 10 can be simplified. Particularly, the in-vehicle antenna having a certain length needs not to be added, so there is an advantage in that no limitation on the arrangement of components is imposed and designing is facilitated.

The driving signal line 60 is connected to the signal line 11 in the front-end unit 16 side via the capacitor 64, so the operating voltage applied from the power source 52 to the driving signal line 60 can be separated and a receiving signal running through the driving signal line 60 alone can be extracted. In addition, the driving signal line 60 is connected to the power source 52 via the choke coil 62, so noises running through the power source line can be prevented from being inputted to the front-end unit 16 via the driving signal line 60 acting as the in-vehicle antenna.

The present invention is not limited to the above described embodiments, and many modifications to the embodiments are possible without departing from the gist of the invention. In the radio receiver 10 shown in FIG. 11, the signal line 60 for driving the light emitting diodes 50 used as the backlight of the liquid crystal display device is used as the in-vehicle antenna. However, another wiring having a small fluctuation in voltage maybe used as the in-vehicle antenna. For example, when there is provided a light emitting diode acting as an indicator indicating that the radio receiver 10 is in operation, an operating voltage with no fluctuation in voltage is applied to the driving signal line for the light emitting diode after when the radio receiver 10 is turned on and until when it is turned off. Thus this same driving signal line can be used as the in-vehicle antenna.

According to the above described embodiments, in the examples shown in FIGS. 5 to 9, the antenna 14A to 14D is formed in the exterior of or on the surface of the housing of the radio receiver 10. However, the antenna may be incorporated into the interior of the housing. Preferably, a variety of the in-vehicle antennas 14A etc. shown in FIGS. 5 to 10 are disposed in a direction such that the receiving state is made satisfactory relative to the antenna 42 provided in the FM transmitter 40. For example, the in-vehicle antenna 14B shown in FIGS. 6 and 7, the in-vehicle antenna 14C shown in FIG. 8, and the in-vehicle antenna 14E shown in FIG. 10 are preferably disposed so that the longitudinal direction thereof is made substantially perpendicular to the direction of placement of the antenna 42. Also, the antenna 14D shown in FIG. 9 is preferably disposed so that the center line of the spiral configuration thereof is made substantially parallel to the direction of placement of the antenna 42.

In the radio receiver shown in FIG. 11, the driving signal line 60 used as the in-vehicle antenna 14 is directly connected to the signal line 11 in the front-end unit 16 side via the capacitor 64. However, the connection between one end of the capacitor 64 and the signal line 11 may be made via the balun 26 shown in FIG. 3 or via the balun 28 shown in FIG. 4 to achieve impedance matching.

In the above described embodiments, the in-vehicle antenna 14 etc. are connected to the signal line 11 within the radio receiver directly or via the balun 26 or 28. However, the in-vehicle antenna 14 etc. may be connected via a loading coil.

Figure 12:
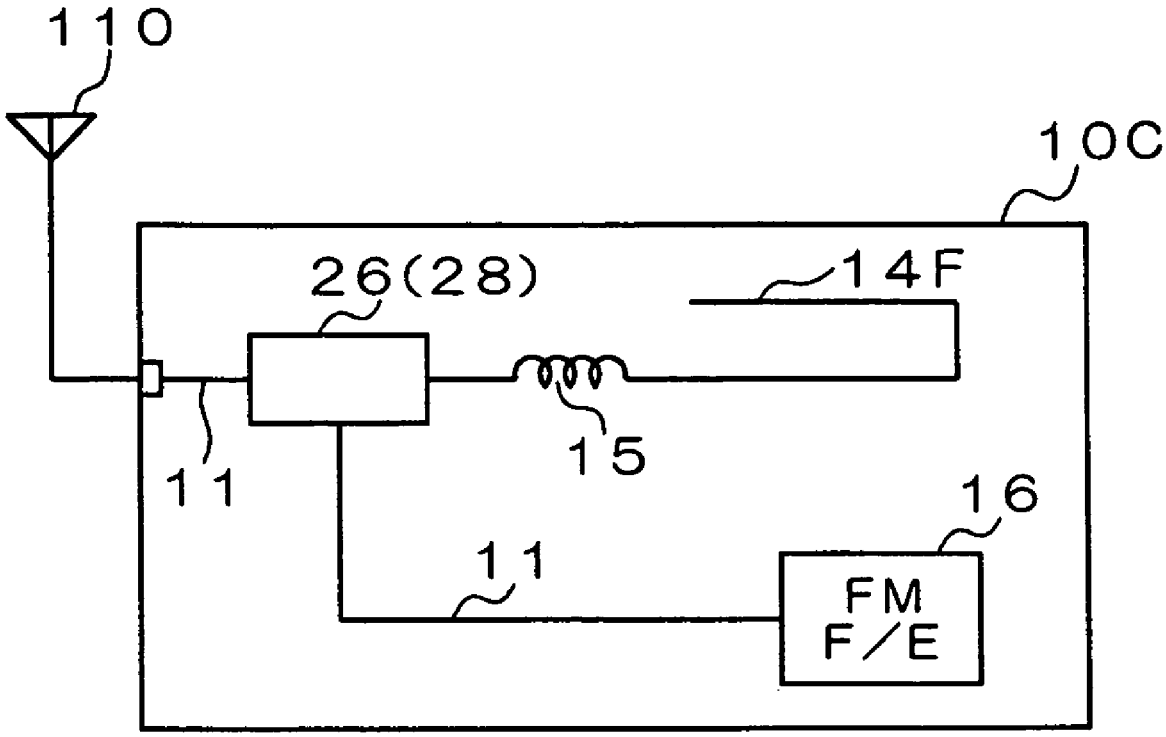
FIG. 12 is a view showing a concrete example of radio receiver having incorporated therein a loading coil.

FIG. 12 is a view showing a concrete example of radio receiver having incorporated therein a loading coil. The radio receiver 10C shown in FIG. 12 comprises a signal line 11, a balun 26 (or a balun 28), an incorporated U-shaped (or linear) in-vehicle antenna 14F, and a loading coil 15 inserted between the balun 26 and the in-vehicle antenna 14F. By virtue of provision of the loading coil 15, the effective length of the entire antenna composed of the loading coil 15 and in-vehicle antenna 14F can be increased. Thus a shorter in-vehicle antenna 14F can be used. Consequently, the in-vehicle antenna 14F can easily be incorporated into the radio receiver 10C and at the same time the size of the radio receiver 10C can be reduced. A loading coil 15 may be added to a variety of the radio receivers shown in FIGS. 2 to 9.

What is claimed is:

1. An FM radio receiver installed within a vehicle room and provided with a vehicle-mounted antenna connection terminal, the FM radio receiver comprising:

a front-end unit converting to an intermediate frequency signal an FM broadcast signal received via a vehicle-mounted antenna;

a signal line inserted between the vehicle-mounted antenna connection terminal and the front-end unit; and an in-vehicle antenna branching out from the signal line.

2. The FM radio receiver according to claim 1, wherein the in-vehicle antenna is connected directly to the signal line.

3. The FM radio receiver according to claim 1, wherein the in-vehicle antenna is connected to the signal line via a loading coil.

4. The FM radio receiver according to claim 1, further comprising a balun inserted in the path of the signal line, wherein the signal line and the in-vehicle antenna are connected to each other via the balun.

5. The FM radio receiver according to claim 4, wherein a loading coil is inserted between the balun and the in-vehicle antenna.

6. The FM radio receiver according to claim 1, wherein the in-vehicle antenna is a wire composed of a flexible metal conductor covered with an insulating material and is exposed to the outside from a housing having housed therein the signal line.

7. The FM radio receiver according to claim 1, wherein the in-vehicle antenna is a wire composed of an inflexible metal conductor covered with an insulating material and is disposed outside the housing having housed therein the signal line and positioned substantially parallel to one face of the housing.

8. The FM radio receiver according to claim 1, wherein the in-vehicle antenna is a conductor attached to the surface or rear surface of a housing having housed therein the front-end unit.

9. The FM radio receiver according to claim 8, wherein the in-vehicle antenna is formed in a spiral manner across the surface or rear surface of the housing.

10. The FM radio receiver according to claim 1, wherein the in-vehicle antenna is a bar antenna composed of a coil wound around a magnetic core and is disposed within the housing having housed therein the front-end unit.

11. The FM radio receiver according to claim 1, wherein a wiring having a small fluctuation in voltage is used as the in-vehicle antenna.

12. The FM radio receiver according to claim 11, wherein the wiring is a signal line for driving a light emitting diode illuminating the screen of a display device.

13. The FM radio receiver according to claim 12, wherein the signal line for driving is connected to the signal line via a capacitor.

14. The FM radio receiver according to claim 12, wherein the signal line for driving is connected to a power source via a choke coil.

15. The FM radio receiver according to claim 11, wherein the wiring is a signal line for driving a light emitting diode indicating the active state.

16. The FM radio receiver according to claim 15, wherein the signal line for driving is connected to the signal line via a capacitor.

17. The FM radio receiver according to claim 15, wherein the signal line for driving is connected to a power source via a choke coil.

* * * * *